US008720754B2

(12) United States Patent
Kirsch

(10) Patent No.: US 8,720,754 B2
(45) Date of Patent: May 13, 2014

(54) LOCKING AND QUICK RELEASE MECHANISM FOR HANDGUN HOLSTERS

(76) Inventor: Saul Kirsch, Waaleijk (NL)

( * ) Notice: Subject to any disclaimer, the term of this patent is extended or adjusted under 35 U.S.C. 154(b) by 291 days.

(21) Appl. No.: 12/688,930

(22) Filed: Jan. 18, 2010

(65) Prior Publication Data

US 2011/0174848 A1 Jul. 21, 2011

(51) Int. Cl.
*F41C 33/02* (2006.01)

(52) U.S. Cl.
USPC ..... 224/244; 224/912; 224/243; 224/198

(58) Field of Classification Search
USPC ..... 224/243, 911, 244, 912, 198, 192, 238, 224/193; 206/317; D3/222; 70/14, 57, 58; 292/4, 16, 8, 32, 248, 109, 179, 177, 292/178, 303, 292, 137, 138, 163, 174, 292/DIG. 61
See application file for complete search history.

(56) References Cited

U.S. PATENT DOCUMENTS

| | | | | | |
|---|---|---|---|---|---|
| 1,750,139 | A * | 3/1930 | Swift | 224/244 |
| 1,951,865 | A * | 3/1934 | Franz | 224/244 |
| 2,349,376 | A * | 5/1944 | Ray | 224/244 |
| 4,277,007 | A * | 7/1981 | Bianchi et al. | 224/193 |
| 4,925,075 | A * | 5/1990 | Rogers | 224/244 |
| 5,372,288 | A * | 12/1994 | Rogers et al. | 224/198 |
| 5,944,239 | A * | 8/1999 | Rogers et al. | 224/193 |
| 6,276,581 | B1 * | 8/2001 | Glock | 224/244 |
| 6,349,496 | B1 * | 2/2002 | Neely | 42/70.11 |
| 6,634,527 | B2 * | 10/2003 | Liu | 224/244 |
| 6,641,009 | B2 * | 11/2003 | French et al. | 224/244 |
| 6,732,891 | B2 * | 5/2004 | Locklear, III | 224/244 |
| 6,752,300 | B2 * | 6/2004 | Har-Shen | 224/244 |
| 6,769,581 | B2 * | 8/2004 | Rogers et al. | 224/243 |
| 7,556,181 | B2 * | 7/2009 | Spielberger | 224/244 |
| 2004/0050887 | A1 * | 3/2004 | Spielberger | 224/244 |

* cited by examiner

*Primary Examiner* — Adam Waggenspack
*Assistant Examiner* — Matthew Theis
(74) *Attorney, Agent, or Firm* — Whitley Legal Group, P.C.; AnnMarie W. Whitley

(57) ABSTRACT

A mechanical mechanism which allows a holster to firmly support and hold steady a pistol or revolver, allowing a smooth and quick release of this locking mechanism when required on the draw. This mechanical mechanism can grip the gun only on the trigger guard area, achieving a solid grip and smooth release by means of a sliding block formed around the shape of the front end of the trigger guard, which slides sideways out of the way as the gun is drawn upwards. Tension adjustment is achieved by applying more or less pressure on this sliding block as it moves up in its track, while the gun is drawn upwards. Total locking is achieved by means of a rotating lever, which locks the sliding block in place, preventing it from moving up at all, when securing the gun is required.

18 Claims, 6 Drawing Sheets

LOCKING AND QUICK RELEASE MECHANISM FOR HANDGUN HOLSTERS

FIELD AND BACKGROUND OF THE INVENTION

The invention is in the field of weapon retention mechanism. More specifically, the present invention is a locking and quick release mechanism for hand gun holsters.

In the field of competition holsters for Practical pistol shooting there are two main designs in use today: competition holsters with a muzzle support, and competition holsters without a muzzle support—such as our design.

A range of holsters have been offered from the dawn of the handgun. The holsters known in the art vary considerably and can be grouped according to central themes. One such group is known as competition holsters with a muzzle support and another is known as trigger guard gripping systems.

Several models of holsters with muzzle support are known in the art including manufacturers and products such as the "CR Speed WSII holster", the "Arredondo holster" and the "Safariland 013 competition".

All of the above holsters commonly rely on a muzzle support to hold the handgun in the holster, and preventing the handgun from being inadvertently displaced (also known as "rocking forward" and "rocking backwards").

Holsters with muzzle support commonly secure the handgun in at least two points—around the trigger guard (as most competition holsters do) and below the muzzle. The below the muzzle support is commonly achieved by either a pin protruding into the muzzle area of the barrel or a cup type design for containing the slide and barrel around the muzzle area.

Although such a configuration simplifies the design of the trigger guard gripping system, as this area no longer has to totally stabilize the gun—but rather much of that is achieved by the muzzle grip.

A latent deficiency of holsters with muzzle supports is the need for such holsters to be considerably longer and at least longer than the gun barrel of the handgun. Such a long design is "clumsy" and is considered a disadvantage by competition shooters, who prefer holsters securing the trigger guard only. A further deficiency of muzzle support holsters includes the latent inability to fit a variety of barrel lengths without adjustment yielding an even larger and bulkier configuration.

A further common design for competition can be grouped into competition holsters devoid of a muzzle support. Holsters devoid of a muzzle support are known in the art including manufacturers and products such as the "Ghost holster by Amadini", the "Speed Sec holster by Hoppner & Shumann", the "Guga Ribas holster" and the "Stealth holster from Limcat".

The holsters in this group support the handgun by securing the trigger guard, allowing the entire gun to be exposed, creating a much more compact design, readily facilitating use of handguns having a multiplicity of barrel length without requiring any adjustments to the holster.

A latent deficiency of such holsters is their inability to ready facilitate a stable platform for the handgun. Although, a variety of barrel lengths can be used without modification, all such holsters are "handgun specific" (one needs to buy a holster per handgun type). A further latent deficiency includes a relative instability such that handguns can still "rock slightly forward" and "rock backwards" in the holster, and thus the handgun is prone to falling out of the holster if inadvertently displaced in a variety of angles. Also, the varying positions of the gun is a disadvantage to the competition shooter when rapidly drawing the handgun for the holster.

The shortcomings of the holsters known in the art include, among others, the following deficiencies for the holster designs detailed hereinbelow.

The Ghost holster utilizes a plastic molded body and a system to situate the trigger guard which has two parts: a spring loaded metal ball, which protrudes into the front of the trigger guard to hold the gun in place wherein the metal ball can be locked by rotating an external lever. Thus, the handgun is secured for the purpose of preventing the handgun "falling out" of the Ghost holster. Nevertheless, without "locking" the handgun with the external lever, which also prevents the handgun from being drawn, the handgun is prone to "rocking forward" and "rocking back" in the holster. An attempt to resolve the problem is by providing a second locking mechanism with a cam shaped locking lever. In use, subsequent to the handgun being situated fully in the holster, the distal part of the trigger guard applies pressure on the "tip" of the cam, such that the "tail end" of the cam is rotated, thereby securing the bottom the edge perpendicular to the distal part of the trigger guard.

The "double lock" mechanism of the Ghost holster secures the handgun and facilitates a relatively "smooth" draw. Nevertheless, the Ghost holster is devoid of a tension adjustment, which adversely affects the benefits of the Ghost holster.

The Speedsec holster from Hoppner & Shumann also utilizes a plastic molded body with a trigger guard retention mechanism. A rotating cam activated in response to a handgun being seated in the holster is provided. Like the Ghost holster, the distal end of the trigger guard rotateably displacing the cam such that a portion protrudes into the trigger guard, thereby securing the handgun. An external lever is also provided for locking the can until the handgun is drawn subsequent to releasing the locking lever.

Thus, due to the Ghost holster being devoid of a tension adjustment to the draw, only "fully locked" and "fully loose" position can be achieved. Moreover, since the cam has to rotateably displace out of place the holster is incapable of offering a "snug" and "tight" position of securing the trigger guard. Furthermore, the locking mechanism of the Ghost holster is rotatably displaceable "in" and "out" of the trigger guard and thus the Ghost holster is "loose" around the area of the trigger guard and thus the locking mechanism does not circumvent instability of the handgun.

Nevertheless, the Speedsec holster is also devoid of a tension adjustment, which adversely affects the benefits of the Speedsec holster.

Thus, due to the Speedsec holster being devoid of a tension adjustment to the draw, only "fully locked" and "fully loose" position can be achieved. Moreover, since the cam has to rotateably displace out of place the holster is incapable of offering a "snug" and "tight" position of securing the trigger guard. Furthermore, the locking mechanism of the Speedsec holster is rotateably displaceable "in" and "out" of the trigger guard and thus the Ghost holster is "loose" around the area of the trigger guard and thus the locking mechanism does not circumvent instability of the handgun.

There is therefore a need for a holster readily facilitating securing a handgun in a "snug" and "tight" position when securing the handgun in the holster and readily facilitating a substantially smooth and rapid draw of the handgun from the holster.

BRIEF SUMMARY OF THE INVENTION

This invention achieves the following goals:

1. It allows a gun to be held securely and without any rocking in a holster design which grips only around the trigger-guard of the gun, without need for a muzzle support. This allows for a more compact holster design and a faster draw due to the short distance required to release the gun from the holster (approx 8 mm of upward motion before the gun is free of the holster)

2. It allows the gun to be release from the holster with a smooth and almost resistance free motion upward—however it will not allow the gun to come loose of the holster in any other direction but straight up.
3. It allows the tension of the draw to be adjusted by the user to suite his tastes and needs.
4. It allows the gun to be locked in the holster, by means of a safety lever which can be disengaged quickly and easily when needed.
5. It allows various guns to be used by changing the locking block assembly only.

Our holster's locking mechanism utilizes a sliding block system which achieves the goals listed above.

According to preferred embodiments of the present invention there is provided a holster including a sliding block wherein the sliding block include a first locking face for engaging a portion of a handgun trigger guard, and a bias attached to the sliding block.

According to further embodiments of the present invention, the sliding block is vectoraly displaceable relative to the holster.

According to still further embodiments of the present invention, the sliding block is vectoraly displaceable at an acute angle to the holster.

According to further preferred embodiments of the present invention there is provided a holster including a sliding block for securing a handgun which sliding block engages a portion of a trigger guard of the handgun, and a bias for readily applying a force against displacing the sliding block.

According to further embodiments of the present invention, the sliding block is transversely displaceable, in response to a handgun being inserted into the holster.

According to still further embodiments of the present invention, the sliding block is transversely displaceable, in response to a handgun being displaced outwardly of the holster.

According to yet further embodiments of the present invention, the holster further includes a controller track formed in the holster for readily controlling displacement of the sliding block.

According to further embodiments of the present invention, the bias is selected from the group consisting of: a "quick draw" bias, a competition bias, a retention bias and a secure bias.

According to still further embodiments of the present invention, the holster further includes a pressure pad attached to the sliding block.

According to yet further embodiments of the present invention, the pressure pad is selected from the group consisting of a compression bias, a leaf bias, and a torsion bias.

According to further embodiments of the present invention, the holster further includes a locking block assembly seated in the holster for readily accommodating a class of handgun.

DETAILED DESCRIPTION OF THE PREFERRED EMBODIMENTS

Figure 1:
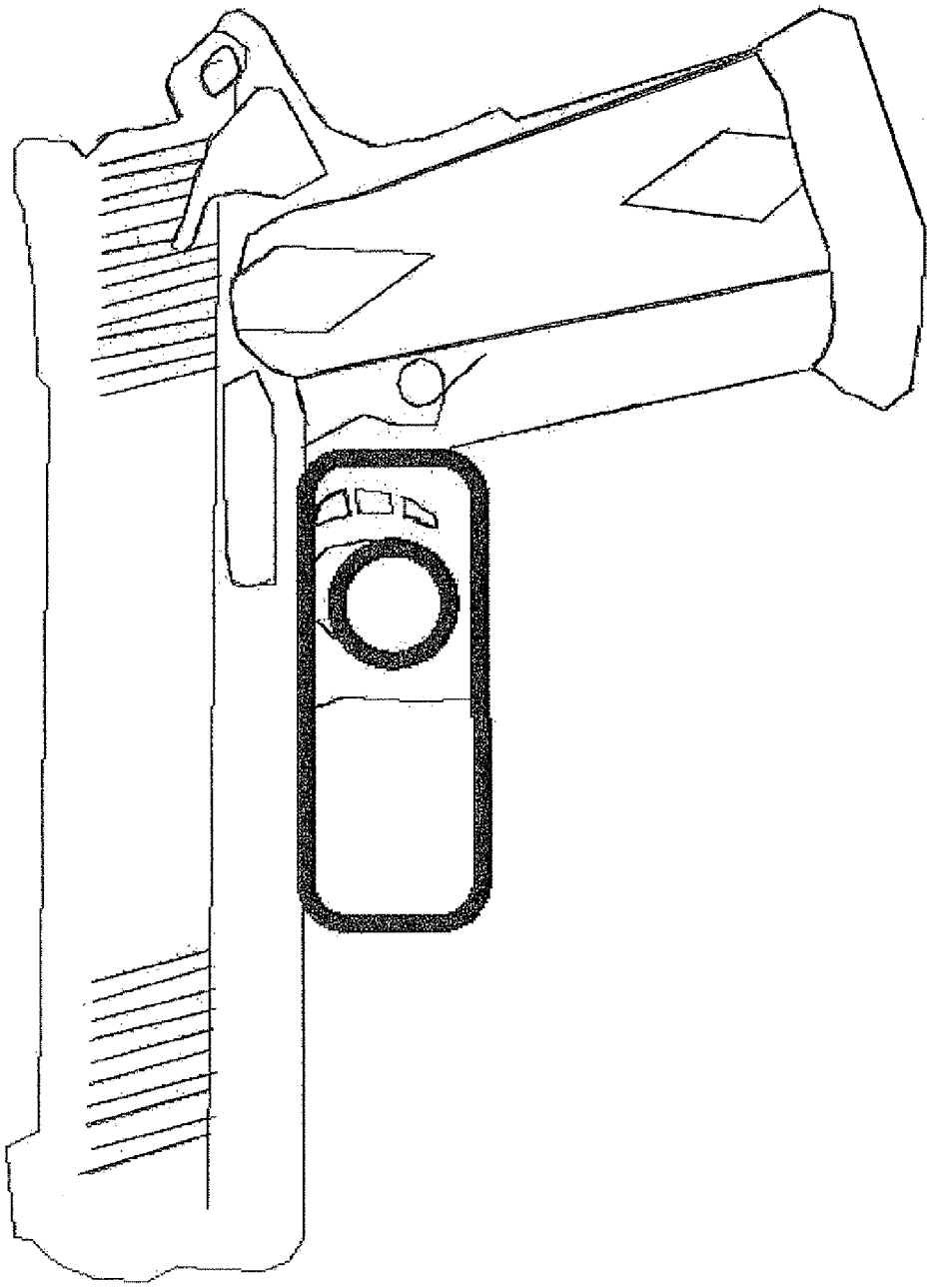
FIG. 1 shows a typical shape of a competition holster which does not utilizes a muzzle support.

The present invention will now be described in terms of specific example embodiments. It is to be understood that the invention is not limited to the example embodiments disclosed.

It should also be understood that not every feature of the methods and systems handling the described device is necessary to implement the invention as claimed in any particular one of the appended claims.

Various elements and features of devices are described to fully enable the invention. It should also be understood that throughout this disclosure, where a method is shown or described, the steps of the method may be performed in any order or simultaneously, unless it is clear from the context that one step depends on another being performed first.

Before explaining several embodiments of the invention in detail, it is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting.

Unless otherwise defined, all technical and scientific terms used herein have the same meaning as commonly understood by one of ordinary skill in the art to which this invention belongs. The systems, methods, and examples provided herein are illustrative only and not intended to be limiting.

In the description and claims of the present application, each of the verbs "comprise", "include" and "have", and conjugates thereof, are used to indicate that the object or objects of the verb are not necessarily a complete listing of members, components, elements or parts of the subject or subjects of the verb.

The subject matter regarded as the invention is particularly pointed out and distinctly claimed in the concluding portion of the specification. The invention, however, both as to system organization and method of operation, together with features and advantages thereof, may best be understood by reference to the following detailed description when read with the accompanied drawings in which: FIG. 1 shows a holster including a locking block. A belt attachment with a ball-joint for adjustment. The holster includes the locking-block assembly where the gun is gripped by its trigger guard.

Figure 2:
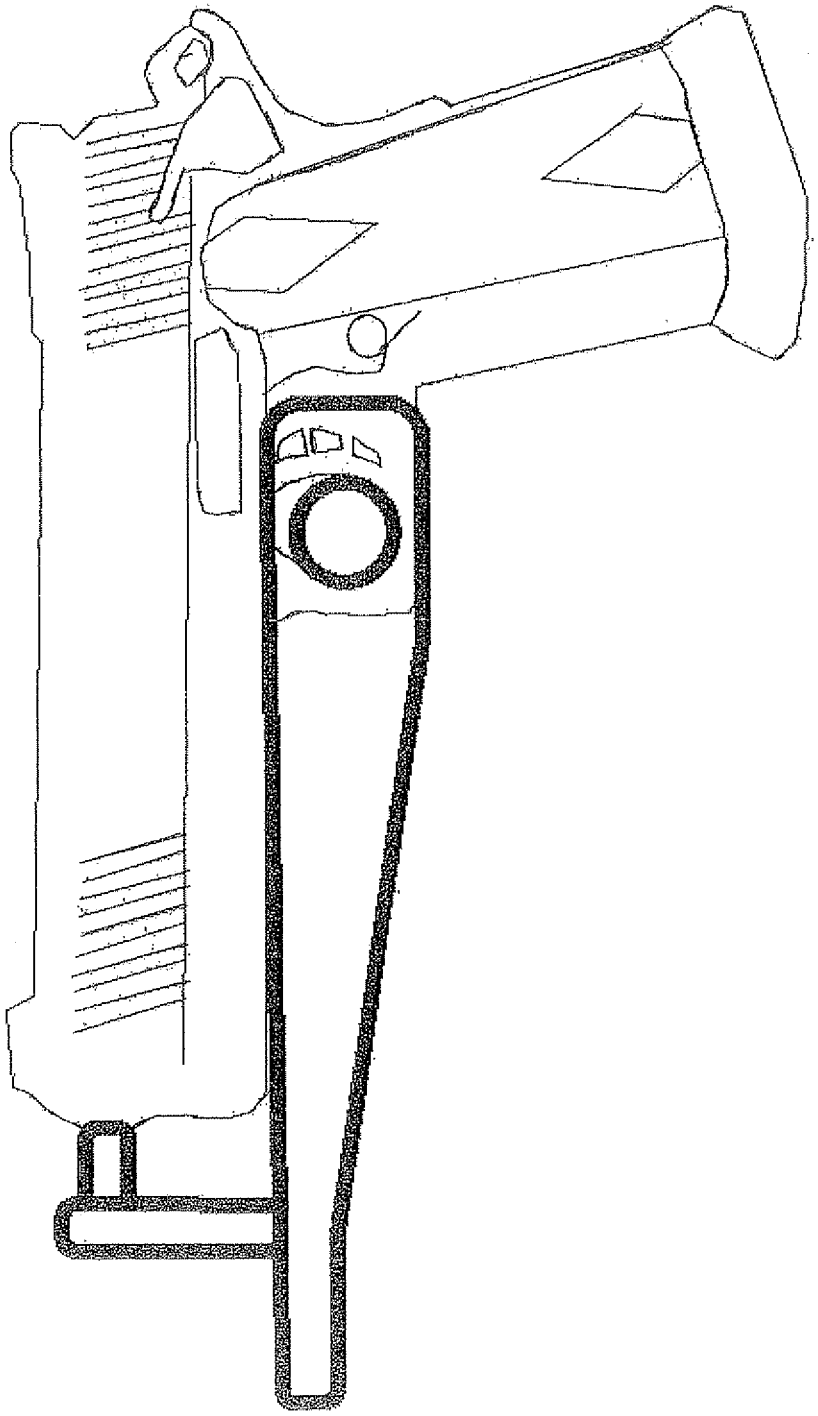
FIG. 2 shows a typical shape of a competition holster which does utilize a muzzle support.

FIG. 2 shows a prior art holster with a muzzle support.

Figure 3:
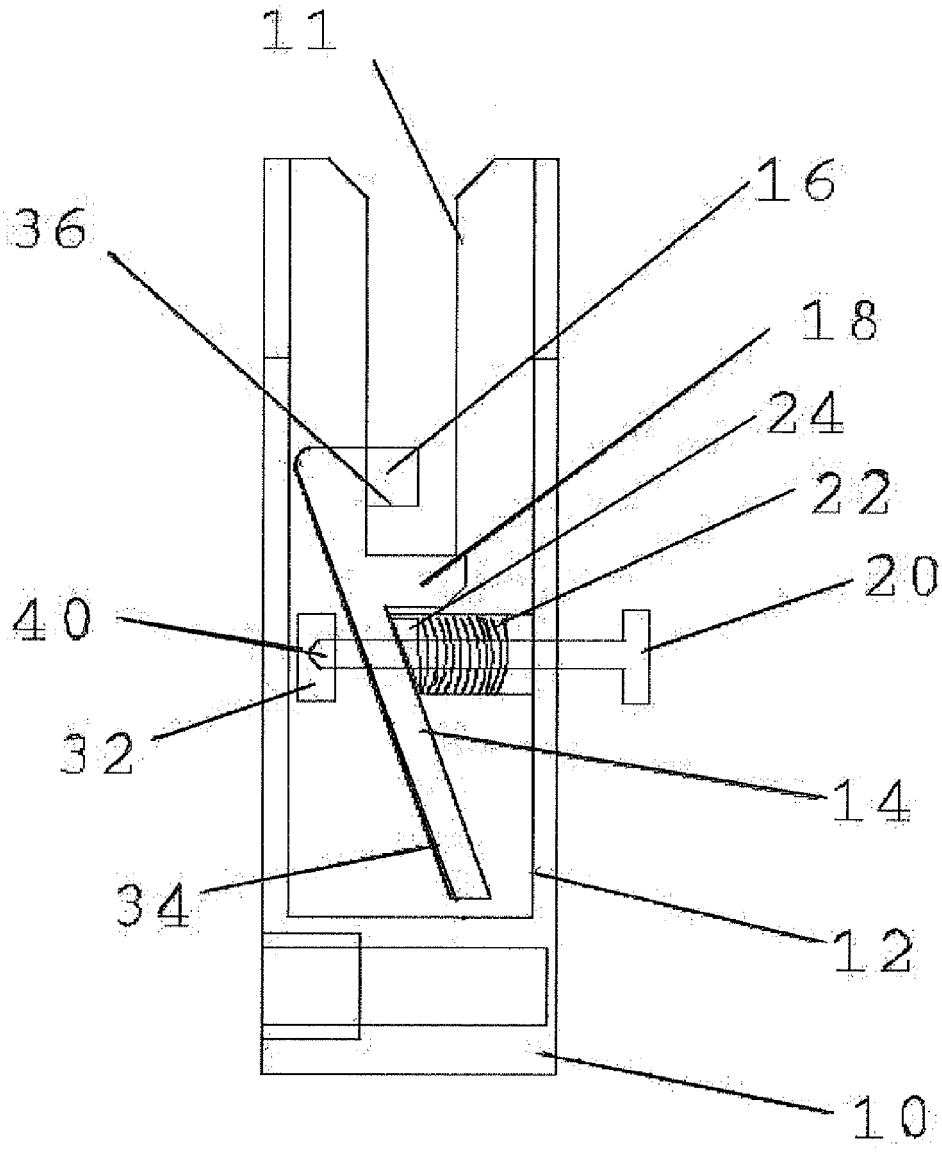
FIG. 3 shows a view of the locking mechanism in the holstered position according to the present invention. The reverse view shows the trigger-guard would be inserted into the grove from above.

FIG. 3 shows a preferred embodiment of the holster locking mechanism 10 according to the present invention. When a gun is seated in the holster locking mechanism 10, the trigger guard of the handgun slides precisely into a matching groove 11 formed in a locking block 12. Preferably, the trigger guard depresses a sliding block 14.

Preferably, the trigger guard depresses a lower tooth 18 of sliding block 14 thereby displacing sliding block 14 to a lower "locked" position as shown in FIG. 3.

As can be seen in FIG. 3, when holster locking mechanism 10 is in the "locked" position. Preferably, in the "locked" position an upper tooth 16 of sliding block 14 is pushed into the trigger guard.

Preferably, upper tooth 16 of sliding block 14 is shaped and contoured for being readily situated in the handgun trigger guard.

Preferably, the displacement of sliding block 14 and upper tooth 16 is controlled by way of an angled controller track 34 attached to, or integrally formed with holster locking mechanism 10. Angular controller track 34 guides and/or controls sliding block 14 and create a substantially lateral displacement of sliding block 14 substantially responsive to sliding block performing a substantially vertical displacement.

Thus, by the trigger guard displacing lower tooth 18, a complimentary lateral displacement of upper tooth 16 is created, thereby "locking" and scuring the trigger guard in holster locking mechanism 10.

Optionally, upper tooth 18 includes a locking face 36 for readily securing the trigger guard and substantially preventing any inadvertent displacement of the handgun during holster locking mechanism 10 being in the "locked" position.

Preferably, locking face 36 engages a portion of the handgun trigger guard by upper tooth being inserted into the trigger guard and gripping the front of the trigger guard securely Preferably, a bias 22 is attached to, or integrally formed with sliding block 14 for readily facilitating applying pressure on sliding block 14 such that inadvertent displacement of sliding block 14 is substantially circumvented.

Preferably, the displacement of sliding block 14 is performed vectoraly in relation to holster locking mechanism 10.

Preferably, the displacement of sliding block 14 is performed vectoraly in relation to holster locking mechanism 10 at an acute angle to holster locking mechanism 10.

Thus, it is especially preferred for sliding block 14 to secure the handgun by sliding block 14 engaging a portion of the trigger guard of the handgun substantially contemporaneously with bias 22 applying a force against inadvertent displacing of sliding block 14.

Optionally, upper tooth 18 is substantially transversely displaceable, in response to a handgun being inserted into holster locking mechanism 10 and lower tooth 16 is transversely displaceable, in response to a handgun being displaced outwardly of holster locking mechanism 10.

Preferably, bias 22 is selected from the group consisting of: a "quick draw" bias, a competition bias, a retention bias and a secure bias.

When the handgun is pulled upward, the inner edge of the front of the trigger-guard pulls upper tooth 16 of sliding block 14 upwards with the handgun being displaced upwards. Due to the angle of angled track 34, substantially upward displacement of the handgun and sliding block 14 is translated into a substantially transverse displacement of upper tooth 16. Thus, the trigger guard is released as sliding block 14 is substantially displaced and upper tooth 16 is no longer preventing the trigger guard from being displaced outwardly, facilitating the handgun to be drawn out of holster locking mechanism 10.

Preferably, resistance to inadvertent substantially upward displacement of sliding block 14 is adjustable and is achieved by means of a tension screw 20. Subsequent to tightening tension screw 20, bias 22 applies more pressure on a pressure-pad 24 which, in turn, pressure pad 24 applies friction to sliding block 14 making the "draw" heavier or lighter as desired.

Similarly, higher degrees of security of the handgun and prevention of inadvertent displacement of the handgun are achieved by adjusting tension screw 20.

Figure 5:
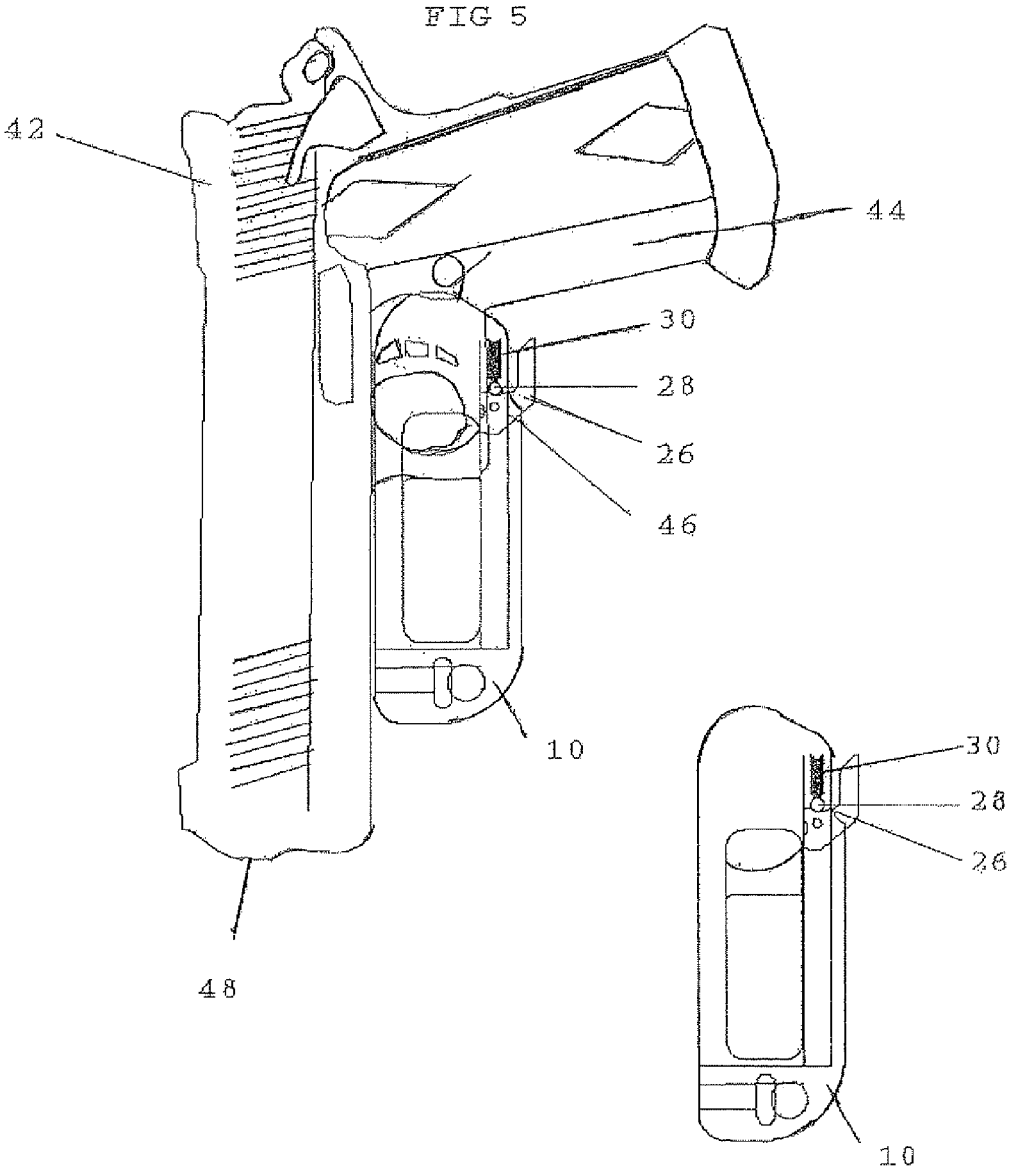
FIG. 5. shows a side view of the holster according to the present invention, showing the safety lever in the open position.

Occasioning on sliding block 14 being in the lower position (once a handgun is holstered) the handgun can be even more securely locked into place using a safety lever 26 as shown in FIG. 5. Preferably, safety lever 26 is rotateably displaceable, thereby creating a barrier, substantially preventing the even deliberate upward displacement of the sliding block 14 of FIG. 3, effectively "locking" holster locking mechanism 10.

Preferably, safety lever 26 of FIG. 5 is engaged by rotateably displacing lever 26 to a position substantially perpendicular to the "open" position. Preferably, safety lever 26 is disengaged by rotateably displacing lever 26 to a position substantially perpendicular to the "locked" position.

Preferably, lever 26 "clicks" into either "open" or "locked" position by way of a protrusion 28 situating in a complimentary indentation on safety lever 26.

Preferably, positive "clicking" into place of safety lever 26 is readily facilitated by means of a lever bias 30 applying pressure on protrusion 28 thereby facilitating displacement of protrusion 28.

Figure 4:
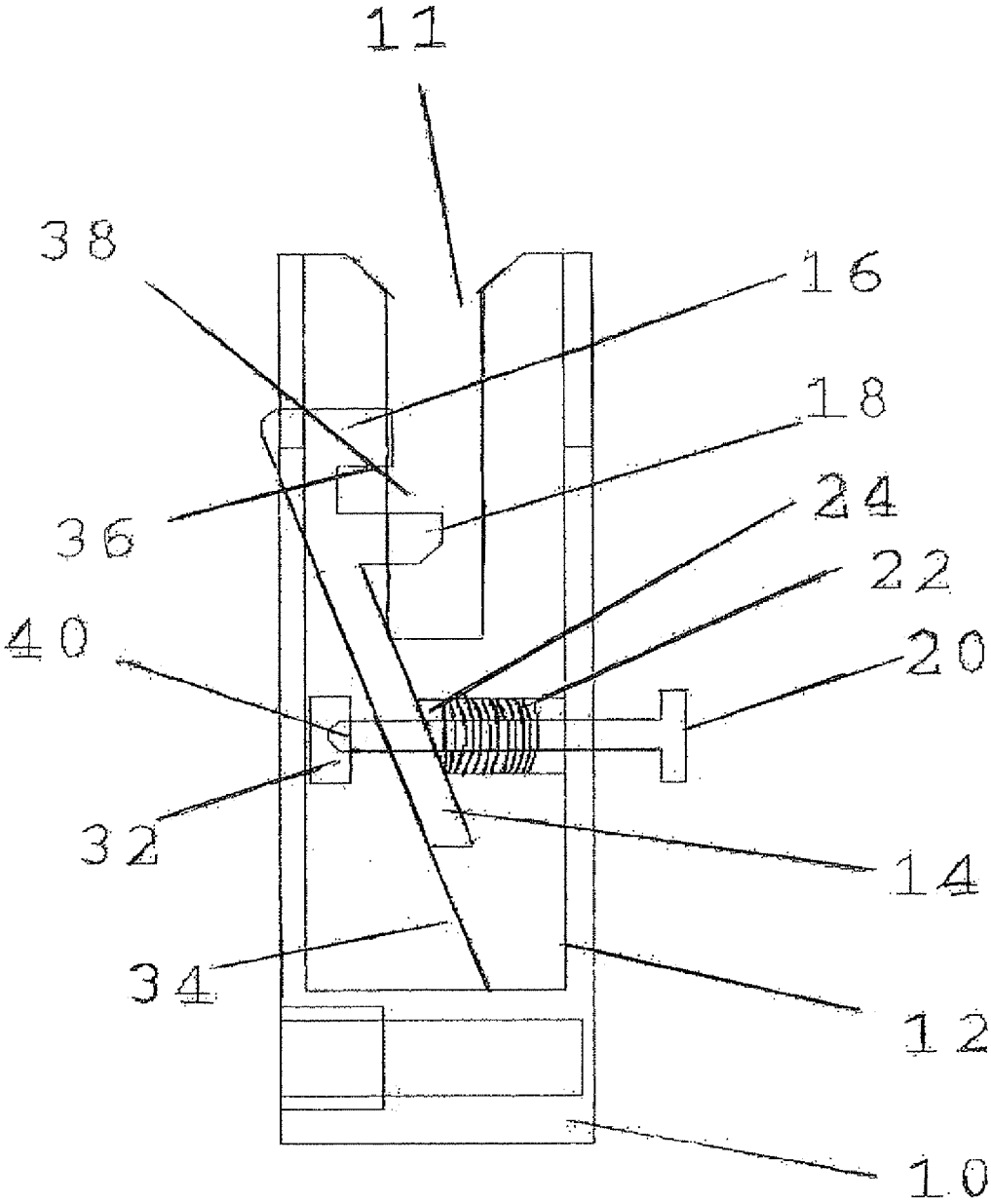
FIG. 4 shows a view of the locking mechanism in the unholstered position according to the present invention. The reverse view shows the trigger-guard would be inserted into the grove from above.

FIG. 4 shows the locking system in the up "open" position, before a handgun is seated into holster locking mechanism 10 or subsequent to the handgun being drawn from holster locking mechanism 10.

Subsequent to the handgun being inserted into holster locking mechanism 10, the trigger guard of the handgun comes down into groove 11 formed in locking block 12 from above.

Subsequent to the front end of the trigger guard being displaced against lower tooth 18 of sliding block 14, sliding block 14 is displaced substantially downwards.

Preferably, controller track 34 is angled substantially between 15-45 degrees, thereby bringing about a corresponding angular displacement of sliding block 14. As sliding block 14 is angularly displaced, upper tooth 16 enters the trigger guard, just above the front arc of the trigger guard.

Optionally, controller track 34 is angled at substantially 20 degrees, thereby bringing about a corresponding angular displacement of sliding block 14

A gap 38 is formed between lower tooth 18 and upper tooth 16 of sliding block 14 is contoured and dimensioned to precisely match the contour and dimensions of the front of the trigger guard for the specific handgun gap 38 formed between lower tooth 18 and upper tooth 16 of sliding block 14 has been designed for.

Thus, gap 38 formed between lower tooth 18 and upper tooth 16 of sliding block 14 is handgun specific for a handgun class.

The term "handgun class" as used herein, shall include but will not be limited to, a specific make of handgun, a specific model of handgun, a specific trigger guard configuration and the like.

Lower tooth 18 and upper tooth 16 of sliding block 14 fit substantially snugly around the front of the trigger guard, thereby substantially preventing the handgun from rocking "forward" and/or rocking "backwards" in holster locking mechanism 10.

Due to lower tooth 18 and upper tooth 16 being laterally displaced, as the handgun is drawn, lower tooth 18 and upper tooth 16 can be dimensioned to precisely fit the contour of the trigger guard thereby providing enhanced "locking" capabilities of holster locking mechanism 10.

Namely, due to lower tooth 18 and upper tooth 16 not being rotateably displaceable and are vectoraly displaced, holster locking mechanism 10 substantially "locks" and secures the handgun in holster locking mechanism 10

FIG. 3 shows holster locking mechanism 10 in the lower position subsequent to the handgun being stuated in holster locking mechanism 10.

Upper tooth 16 protrudes considerably into groove 11 formed in holster locking mechanism 10 where the trigger guard of the handgun would be situated and secured. Upper tooth 16 substantially protrudes into the trigger guard, thereby securing the trigger guard and preventing an inadvertent displacement of the handgun. Preferably, the handgun cannot rock forward or rock back, and the handgun can only be removed in a substantially straight vertical motion.

Preferably, occasioning on controller track 34 being angled at substantially 20 degrees from the vertical line of sliding block 14, a substantially vertical displacement of substantially 8 mm is preferably sufficient for the trigger guard to "clear" upper tooth 16 and facilitate a rapid draw of the handgun.

Namely, substantially vertical displacement of sliding block 14 corresponds to a substantially lateral displacement of upper tooth 16, thereby readily facilitating the handgun to rapidly be removed forward from holster locking mechanism 10.

Subsequent to the handgun being drawn, as shown in FIG. 4, lower tooth 18 is then protruding into the groove 11 formed in holster locking mechanism 10, until the handgun is reholstered by pressing the trigger guard against upper tooth 16 and displacing until locking face 36 passes through the trigger guard.

Preferably, a tension adjustment of the draw, also known as how hard the user has to pull on the handgun to draw the handgun out of holster locking mechanism 10 is readily achieved by tightening or loosening of tension screw 20.

Preferably, subsequent to tightening tension screw 20, a corresponding tension screw nut 32 is attached to, or integrally formed with, locking block 12.

Preferably, an end 40 of tension screw 20 is readily accommodated by tension screw nut 32 such that rotation of tension screw 20 translates to lateral displacement of tension screw 20. Thus, lateral displacement of tension screw 20 affects the force applied by bias 22 on pressure pad 24.

Preferably, a user can adjust the tension of bias 22 by rotating tension screw 20 and increasing or decreasing the friction of sliding block 14 within holster locking mechanism 10 and either making the draw of the handgun harder (heavier) or easier (lighter).

Occasioning on tension screw 20 being loosened, pressure on bias 22 is relaxed, applying less pressure on pressure pad 24 and thereby allowing sliding block 14 to slide up and down more freely, with less friction, creating a smoother and lighter draw of the gun.

Optionally, pressure pad 24 can be constructed of a material selected from the group consisting of: machined aluminum, Delrin or other suitable material. The pressure can be applied and adjusted to pressure pad 24 using bias 22 (as shown in FIG. 3 and FIG. 4) or by way of non-limiting examples only, by way of a leaf bias or a torsion bias.

Figure 6:
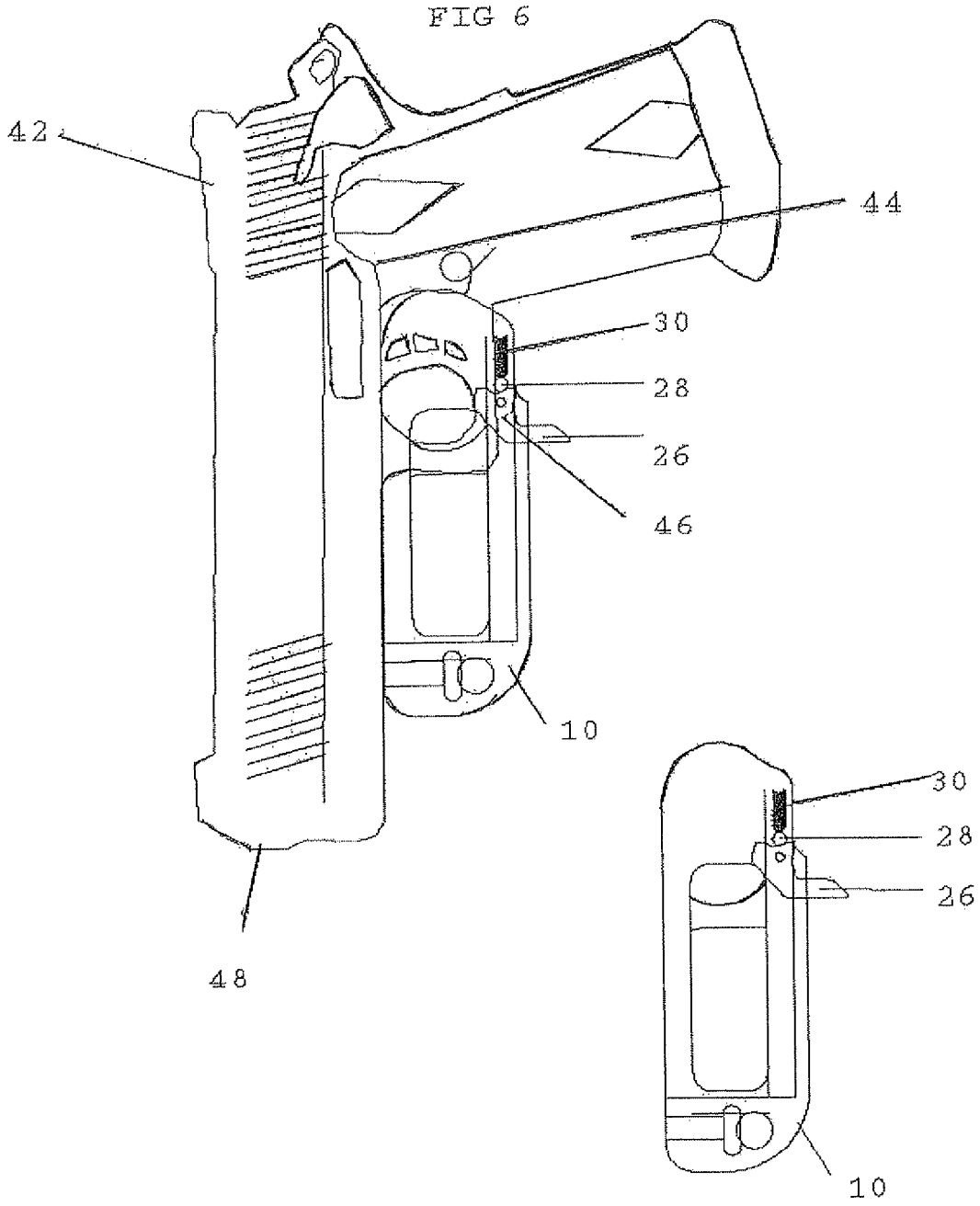
FIG. 6 shows a side view of the holster according to the present invention, showing the safety lever in the locked ("safe") position.

As shown in FIG. 5 and FIG. 6, holster locking mechanism 10 can be secured, thereby preventing deliberate drawing of a handgun 42 by way of safety lever 26.

Preferably, safety lever 26 lever is situated in adjacency to a grip 44 of handgun 42 such that safety lever 26 is readily reachable by the shooters index finger as the clasps grip 44 of handgun 42.

FIG. 5 shows safety lever 26 in an unlocked position. Preferably, safety lever 26 has been rotated substantially perpendicularly, thereby co-aligning a locking tip 46 of safety lever 26 with a barrel 48 of handgun 42 and out of the way of sliding block 14 facilitating sliding block to be displaced to release handgun 42 from holster locking mechanism 10.

FIG. 6 shows safety lever 26 in the engaged (locked) position. In this position, safety lever 26 protrudes out roughly parallel with grip 44 of handgun 42 readily facilitating access to the user for an easy and fast disengagement of safety lever 26 with an index finger, as the hand of the user closes around grip 44 of handgun 42.

Locking tip 46 of safety lever 26 in this position is rotated to protrude and block sliding block 14 from being displaced. By preventing sliding block 14 from being displaced handgun 42 cannot be drawn out of holster locking mechanism 10.

Pressing from above on safety lever 26 is a small protrusion 28 which is bias loaded by a safety lever bias 30. Small protrusion 28 presses into corresponding indentations cut into safety lever 26, thereby affixing the position of safety lever 26, either in the locked position or the unlocked position.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims. In particular, the present invention is not limited in any way by the examples described.

I claim:

1. A holster comprising:

a) a locking block comprising a groove formed in the locking block wherein the groove is configured to receive at least a portion of a handgun trigger guard;

b) a controller track attached to the locking block wherein the controller track is positioned at an acute angle relative to the groove;

c) a sliding block slidably secured to the controller track such that the sliding block translates along the controller track, wherein said sliding block comprises at least one upper tooth configured to substantially cooperate with the trigger guard of said handgun when the trigger guard is placed in the groove of the locking block; and d) a bias assembly attached to the sliding block and configured to limit motion of said sliding block with frictional force such that when the handgun trigger guard is not present in the locking block, the sliding block remains positioned in an upper position and the upper tooth remains substantially retracted from the groove.

2. The holster of claim 1, wherein said sliding block further comprises a lower tooth and wherein the upper tooth and the lower tooth are integrally formed with the sliding block and wherein the displacement of the lower tooth causes a complimentary displacement of the upper tooth.

3. The holster of claim 1, wherein the bias assembly is adjustable and limits motion of the sliding block with frictional force.

4. The holster of claim 1, wherein said sliding block translates along the controller track from an upper position to a lower position in response to a handgun being inserted into said holster.

5. The holster of claim 1, wherein said sliding block translates along the controller track from a lower position to an upper position in response to a handgun being removed from said holster.

6. The holster of claim 2, wherein the upper tooth and lower tooth are dimensioned to precisely fit the contour of said trigger guard thereby providing enhanced "locking" capabilities of said holster.

7. The holster of claim 1, wherein the upper tooth of the sliding block substantially protrudes into the groove formed in the locking block when the sliding block is positioned in the lower position thereby securing said trigger guard and preventing an inadvertent displacement of said handgun.

8. The holster of claim 1, wherein the groove is substantially vertical, wherein the controller track is angled 20 degrees relative to the groove, and wherein the upper tooth is configured such that a vertical displacement of substantially 8 mm of the sliding block from the lower position to the upper position is sufficient for the upper tooth to simultaneously displace laterally and release the trigger guard and facilitate a rapid draw of the handgun.

9. A holster comprising:

a) a locking block comprising a groove formed in the locking block wherein the groove is configured to receive at least a portion of a trigger guard of said a handgun;

b) a sliding block slidably positioned adjacent the locking block such that the sliding block translates between and upper position and a lower position at an acute angle relative to the groove and wherein said sliding block comprises at least one upper tooth configured to substantially cooperate with the trigger guard of said handgun when the trigger guard is placed in the groove of the locking block; and c) a bias assembly attached to the sliding block wherein the bias assembly is configured to apply frictional force against displacing said sliding block such that when the handgun trigger guard is not present in the locking block, the sliding block remains in the upper position and the upper tooth remains substantially retracted from the groove.

10. The holster of claim 9, further comprising a controller track integral with the locking block and positioned at an acute angle relative to the groove of the locking block, wherein the sliding block translates along the controller track between the upper position and the lower position.

11. The holster of claim 9, further comprising a sliding block limiter for limiting displacement of said sliding block.

12. The holster of claim 11, wherein said sliding block limiter is selected from the group consisting of a pin, a rotatable cam and an insertable cam.

13. The holster of claim 9, further comprising a locking block assembly seated in said holster for readily accommodating a class of handgun.

14. The holster of claim 9, wherein the groove is substantially vertical and the angle at which the sliding block translates relative to the vertical groove is such that a substantially vertical displacement of said sliding block from the lower position to the upper position corresponds to a substantially lateral displacement of the upper such that the upper tooth releases the trigger guard thereby allowing the handgun to be rapidly removed from said holster.

15. The holster of claim 9, wherein the groove is substantially vertical and the sliding block translates at an angle of 20 degrees relative to the substantially vertical groove formed in the locking block and wherein the upper tooth is configured such that a vertical displacement of substantially 8 mm of the sliding block from the lower position to the upper position is sufficient for the upper tooth to simultaneously displace laterally and release the trigger guard and facilitate a rapid draw of the handgun.

16. A holster comprising:

a) a locking block comprising a groove formed in the locking block wherein the groove is configured to receive at least a portion of a handgun trigger guard;

b) a controller track attached to the locking block and positioned at an acute angle relative to the groove;

c) a sliding block slidably secured to the controller track such that the sliding block translates along the controller track between an upper position and a lower position, wherein said sliding block comprises:

i) an upper tooth configured and positioned to protrude into the groove of the locking block when the sliding block is in the lower position and to substantially clear the groove of the locking block when the sliding block is in the upper position; and ii) a lower tooth configured and positioned to protrude into the groove of the locking block when the sliding block is in the upper position; and d) an adjustable bias assembly attached to the sliding block and configured to frictionally limit motion of the sliding block along the controller track such that when the handgun trigger guard is not present in the locking block, the sliding block remains in the upper position.

17. The holster of claim 16 wherein the controller track is positioned at an angle between 15 and 45 degrees relative to the groove.

18. The holster of claim 17 wherein the controller track is positioned at a 20 degree angle relative to the groove.

* * * * *